US009021627B2

(12) United States Patent
Parker et al.

(10) Patent No.: US 9,021,627 B2
(45) Date of Patent: May 5, 2015

(54) TENSION ROD WITH THREADED END CAP

(71) Applicants: Maurice S. Parker, Kinston, NC (US); Melvin Walker, Jr., Goldsboro, NC (US)

(72) Inventors: Maurice S. Parker, Kinston, NC (US); Melvin Walker, Jr., Goldsboro, NC (US)

(73) Assignee: Ex-Cell Home Fashions, Inc., New York, NY (US)

( * ) Notice: Subject to any disclaimer, the term of this patent is extended or adjusted under 35 U.S.C. 154(b) by 207 days.

(21) Appl. No.: 13/799,052

(22) Filed: Mar. 13, 2013

(65) Prior Publication Data

US 2014/0259368 A1 Sep. 18, 2014

(51) Int. Cl.
*A47K 3/022* (2006.01)
*A47K 3/38* (2006.01)

(52) U.S. Cl.
CPC ..... *A47K 3/38* (2013.01)

(58) Field of Classification Search
USPC ..... 4/610, 557, 558, 607, 608; 211/105.4, 211/123
See application file for complete search history.

(56) References Cited

U.S. PATENT DOCUMENTS 3,951,269 A * 4/1976 Anderson ..... 211/105.4
2012/0005823 A1 1/2012 Baines
2012/0261371 A1 10/2012 Baines

* cited by examiner

*Primary Examiner* — Tuan N Nguyen
(74) *Attorney, Agent, or Firm* — Buchanan Ingersoll & Rooney PC

(57) ABSTRACT

We provide a tension adjustment assembly including an externally threaded support member and an at least partially hollow cylinder that is threaded internally. The threads of the cylinder and the threads of the support member are mated, allowing the cylinder to rotate about and travel along the threaded portion of the support member. The cylinder further comprises a ridge about an outer diameter of the cylinder. The tension adjustment assembly also includes an end cap retained on the cylinder by said ridge and able to rotate freely about said cylinder independently of any rotation of the cylinder about the support member. Finally, the tension adjustment assembly includes a foot attached to the end cap. When placed on the end of a tension rod this assembly allows the fit of the rod to a wall to be adjusted by turning the cylinder.

12 Claims, 4 Drawing Sheets

TENSION ROD WITH THREADED END CAP

BACKGROUND OF THE INVENTION

1. Field of the Invention

Embodiments of the invention relate to tension rods, and in particular, shower curtain rods configured to include a twist end assembly allowing them to be secured in position.

2. Description of the Related Art

Shower curtain rods are configured to hold a shower curtain and/or shower curtain liner within a shower stall or bathtub to minimize water egress from the shower or bath when a shower head is used. Shower stalls, bathtubs, and other enclosures where a shower curtain rod might be used typically vary in size. Therefore, adjustable shower curtain rods are desirable to accommodate the differently-sized spaces where they may be used. Shower curtain rods may also be used as racks for holding towels, clothes, or other items.

Because of the many support functions of the shower curtain rods, it is important that they be able to be installed to provide adequate support for the shower curtain, shower curtain liner, and/or other items to be supported. Typical tension rods attempt to accommodate this need through the use of a single spring inserted in all or part of the length of the rod that applies force to push the ends of the rod apart. This has a number of disadvantages, including being difficult and time-consuming to configure.

BRIEF SUMMARY OF THE INVENTION

Embodiments of the invention provide a curtain rod, preferably but not exclusively a shower curtain rod, that includes a rod with a tension adjustment assembly at one or both ends of the rod. One embodiment provides a load-supporting rod assembly configured to engage opposing surfaces, with the rod assembly including a first rod portion extending between a first end and a second end, with the first rod portion defining an outer diameter; a second rod portion extending between a first end and a second end, wherein the second rod portion defines a first cavity extending within the second rod portion from the first end of the second rod portion, and wherein the first cavity has an inner diameter that is larger than the outer diameter defined by the first rod portion, such that the second rod portion is configured to receive at least a part of the first end of the first rod portion within the second cavity via the first end of the second rod portion. There may be a spring or other tension-adjusting device in the rod to allow tension to be applied and to force the rod portions apart.

On at least one of the second end of the first rod portion or the second end of the second rod portion there is a tension adjustment assembly comprising a support member affixed to one outer end of the rod, where the support member is externally threaded along at least a portion of its length. The tension adjustment assembly further includes a hollow cylinder that is threaded internally. The threads of said cylinder and the threads of the support member are mated, allowing the cylinder to rotate about and travel along the threaded portion of the support member. The cylinder further comprises a ridge about an outer diameter of the cylinder. The tension adjustment assembly also includes an end cap retained on the cylinder by said ridge and able to rotate freely about said cylinder independently of any rotation of the cylinder about the support member. Finally, the tension adjustment assembly includes a foot attached to the end cap.

In some embodiments, hollow cylinder has a surface treatment. The surface treatment may be ornamental, and/or it may increase friction of an external surface of the cylinder relative to friction of the external surface of the cylinder without the surface treatment.

The threaded support member may be integral with a rod end. It may also be held in a rod end by crimping a rod end or by adhesive. The ridge on the outer diameter of the cylinder may be continuous, or it may include a number of interruptions.

In other embodiments the tension adjustment assembly is presented independently of a rod. In another embodiment the rod may be a single rod without a spring or other separating device. Typically the end of the rod opposite the tension adjustment assembly will include an end cap and foot that match the tension adjustment assembly in appearance.

Further embodiments will be discussed in more detail in the attached figures and specification.

DETAILED DESCRIPTION OF THE FIGURES

FIG. 2(*b*) shows the same view, but with the tension adjusted.

DETAILED DESCRIPTION OF THE INVENTION

Embodiments of the invention will now be described more fully with reference to the accompanying drawings. Like numbers refer to like elements throughout the figures.

1. Description of Components

Figure 1:
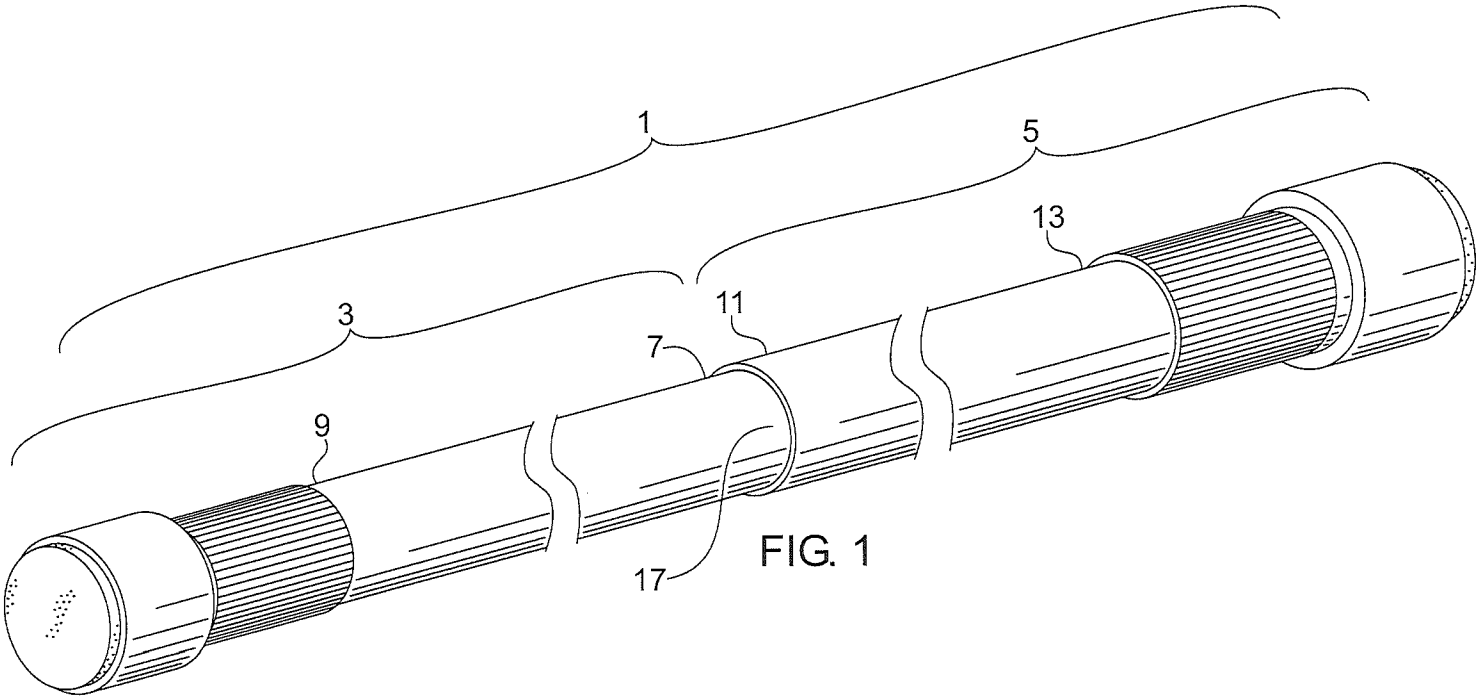
FIG. 1 illustrates a perspective view of a rod assembly according to one embodiment of the invention.

FIG. 1 illustrates a telescoping, load supporting rod assembly according to an embodiment of the invention. The rod assembly 1 includes a first rod portion 3 and a second rod portion 5. The first rod portion has opposing ends 7 and 9, and the second rod portion has opposing ends 11 and 13. The first rod portion rod portion defines a cavity 15 at end 9. The remainder of the first rod portion may be hollow or solid.

The second rod portion 5 defines a second cavity 17 at the first end 11 of the second rod portion 5. The remainder of the second rod portion may be hollow or solid. The first rod portion may be inserted into the second cavity 17, forming a two-piece rod in which the first section is able to slidably move within the second section. This is accomplished by having all or part of the end of the first rod that inserts into the second cavity 17 have a diameter that is less than the diameter of the second cavity.

Often a spring (not shown) or other means of separating the rods and providing some of the tension necessary to keep the rod in place, is provided. Other means might include, for example, an elastic cushion. The separating means is inserted into the second cavity prior to insertion of the first rod section. The biasing means, if present, will provide tension that assists in keeping the assembled rod wedged between two surfaces. In other embodiments the first and second rod sections may be held in a tensioned arrangement by friction (for example, through an interference fit) or by a screw. Other suitable devices for affixing the first rod portion to the second rod portion are disclosed in U.S. patent application Ser. No. 13/222,916, filed on Aug. 31, 2011, for "Quick Lock Tension Rod and Associated Methods." That application is incorporated by reference herein. Although not required, in some embodiments the second rod portion may include a gasket that enhances the fit between the first rod and the second cavity 17, allowing for lower machining tolerances in creation of the rod portions. The gasket may be, for example, plastic.

Figure 2A:
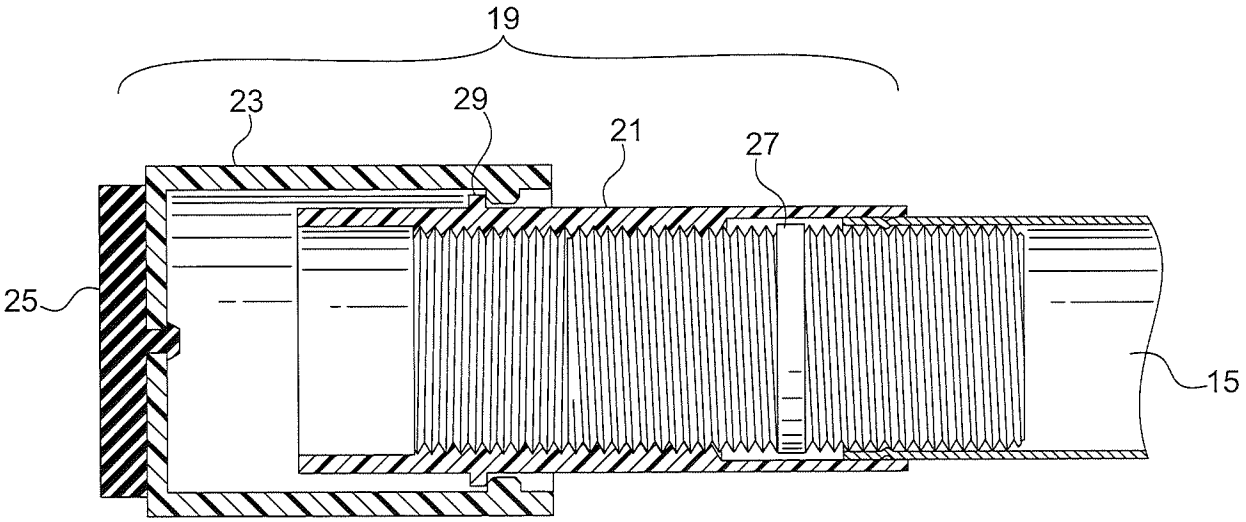
FIG. 2(*a*) illustrates a cutaway view of a portion of a rod assembly showing a tension adjustment assembly as part of the rod assembly.
Figure 2B:
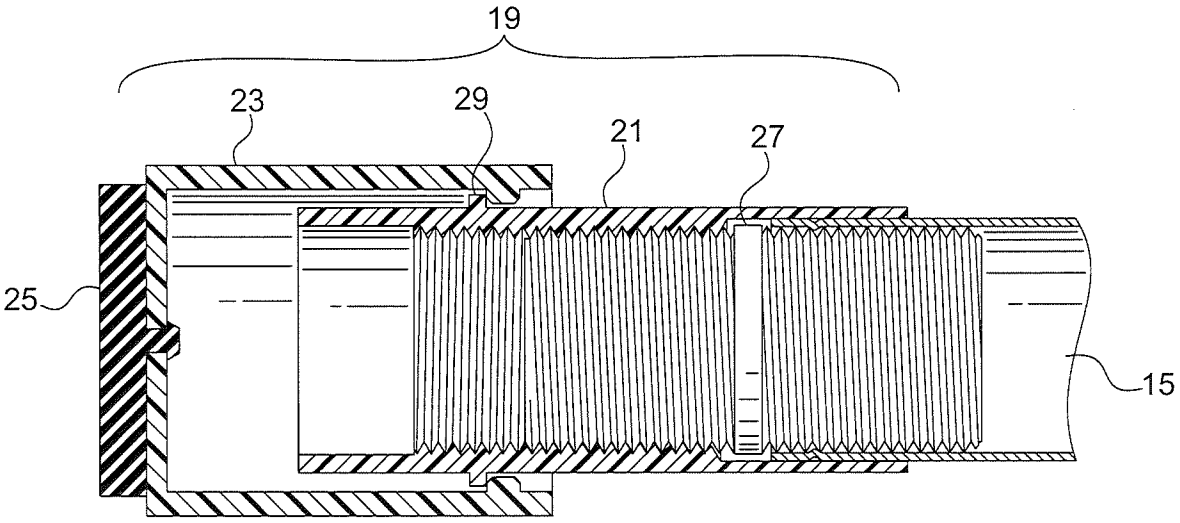
Figure 3:
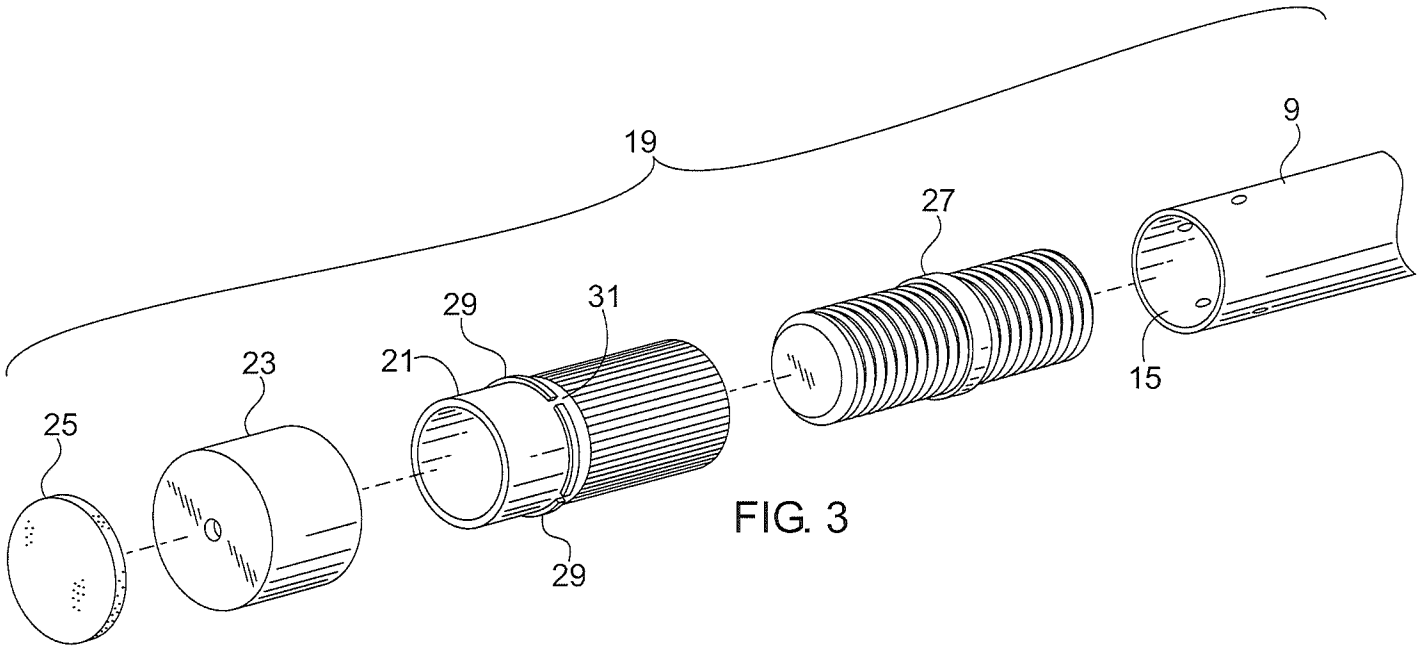
FIG. 3 illustrates an exploded view of a portion of a rod showing a tension adjustment assembly of an embodiment of the invention.

FIGS. 2(*a*) and 2(*b*) shows a cutaway view of a tension adjustment assembly 19 disposed within the first cavity 15, in two separate degrees of tension. An exploded view of the tension adjustment assembly 19 is shown in FIG. 3. The tension assembly comprises or, in some embodiments, consists of, four elements: a hollow, internally threaded cylinder 21, end cap 23, foot 25, and support member 27. The support member includes external threads. The support member may be integral with an adjacent rod end (that is, the end of the rod may be threaded), or it may be disposed partially within a cavity defined by a rod end or around a rod end, then held in place by crimping, adhesive, screws, bolts, threads, or other means. The cylinder is at least partially hollow to accommodate the support member.

FIG. 3 further shows a circumferential ridge 29 extending around the circumference of the threaded cylinder 21. Although the figure shows the circumferential ridge as including multiple uniformly-spaced interruptions 31, the circumferential ridge need not be interrupted, or if the present the interruptions need not be uniformly spaced.

The threaded cylinder, the support member, and the end cap are typically made of plastic. However, they may be made of any other material or combination of materials sufficient to withstand the stress that is present when the tension adjustment assembly is engaged with a surface and the rod is in use. The foot may be made of any material that provides sufficient friction for engagement with a surface to which the rod is intended to be temporarily affixed.

The threaded cylinder includes threads that mate with those on the support member, allowing the threaded cylinder to travel along the length of the support member by rotation of the threaded cylinder. The amount of force needed to rotate the threaded cylinder may be moderated by increasing or decreasing the number of threads. A threaded cylinder may be, but typically is not, threaded along its entire interior.

The threaded cylinder may include one or more patterns on its outside. These patterns may be solely ornamental, or, preferably, they may provide a slip-resistant surface to assist a user in rotating the cylinder when the rod is temporarily affixed to a wall. For example, as shown in the figures the threaded cylinder may be scored.

The end cap and the foot may be associated in a number of ways. In one embodiment the foot is held in place by adhesive. In another embodiment the foot is held in place on the end cap by an interference fit. Typically this interference fit results from having one or more protrusions on the foot opposite the end of the foot designed to engage a wall or other surface. The end designed to engage a wall or other surface is normally flat.

Normally a rod includes only one tension adjustment assembly. The other end of the rod typically includes a cylinder, end cap, and foot that match in outward appearance but are firmly affixed to the rod.

When the tension adjustment assembly is fully assembled, the edge of end cap 23 extends over one end of the end cap, then over the ridge. The end cap is able to rotate freely about the ridge without being able to easily fall off the rod. This may be attained, for example, by having the interior diameter of the end cap be only slightly greater than the exterior diameter of the threaded cylinder. Use of a ridge rounded only on the side closest to the foot and straight on the opposing side also helps prevent the end cap from removal. The threaded cylinder is placed over the support member, then rotated so that the threads of the threaded cylinder mate with those of the support member. Although not necessary to all embodiments, in some embodiments the end cap includes a second ridge or a groove that facilitates engagement with the ridge of the threaded cylinder without hindering rotational movement of the end cap.

Operation of the tension adjustment assembly is straightforward. A user places opposite sides of the rod between opposing surfaces, then slidably extends the rod until the one foot on each side of the rod is in contact with one of the opposing surfaces. The threaded cylinder is then rotated in the direction necessary for it to travel away from the center of the rod and toward the nearest opposing surface. Because the end cap and therefore the attached foot may rotate freely about the threaded cylinder, contact of the foot with the nearest opposing surface will not interfere with continued rotation of the threaded cylinder. This allows the tension to be increased further than one would be able to increase the tension of the end cap and threaded cylinder were integral with each other.

The tension adjustment assembly reported herein provides other advantages. For example, a user need only rotate the threaded cylinder for as much or as little tension as is desired, rather than being limited to a fixed amount. The free rotation of the end cap allows a tight fit to be accomplished without rotation of the foot resulting in the rod end traveling up or down the surface to which it is being temporarily affixed. The shape of the threaded cylinder is easy to grasp and rotate. The resulting tension fit offers enhanced stability relative to other rods in the art.

Although embodiments of the invention are presented relative to an embodiment including a telescoping rod in which the tension assembly is located in a cavity of the rod portion having the lesser diameter of the two rod portions, in other embodiments a tension assembly may be located in a cavity in the rod portion having the greater diameter of the two rod portions. In another embodiment a rod may include two tension assemblies such that one is located in each end of the rod.

In a further embodiment the rod is not a two-piece telescoping rod, but is instead a single-piece rod that includes a tension assembly at one end or both ends. Although this embodiment would likely require more careful measurements from the user to ensure that the tension rod would engage opposite surfaces when the tension assembly is engaged, the embodiment may be preferred for reasons of strength or aesthetics.

There is no requirement for the composition of the first and second rod portions. Typically they are made of the same material, though that is not required. Ideally they will be of sufficient strength to withstand long-term and use at tensions that may be achieved by embodiments of the invention. Use of a telescoping rod allows a user to purchase a single rod that may be used in multiple locations without requiring measurements to a high degree of accuracy of the distance to be spanned by the rod.

Although the embodiments that are shown include rods and tubes that appear to be right circular cylinders, one of skill in the art will appreciate that no particular cross-section for the rod is required so long as a first rod portion is able to slidably engage with the second rod portion.

2. Assembly

With the above information, assembly of a rod with a tension adjustment assembly according to an embodiment of the invention is straightforward. A support member is placed into a rod end, then the rod end is crimped to avoid movement of the support member. Part of the support member protrudes from the rod end, and is able to accept the threaded cylinder. The foot is affixed to the end cap, and the end cap is placed on the threaded cylinder past the point where it engages with the ridge.

3. Additional Embodiments

Various embodiments have been described herein in the context of a shower tension rod. However, it should be understood that this tension adjustment assembly is useful in many situations in which a tension rod is desired. For example, it may be used in windows throughout a home or other edifice. A user might affix opposing surfaces at any point on a wall, then tension the rod between them. Although a shower curtain or ornamental window curtain have been suggested as suitable for placement on the rod, in cases where no curtain is desired, required, or necessary, the rod may be included with a different hanging or none at all.

We claim:

1. A load-supporting rod assembly configured to engage opposing surfaces, the rod assembly comprising:

a first rod portion extending between a first end and a second end, said first rod portion defining an outer diameter;

a second rod portion extending between a first end and a second end, wherein the second rod portion defines a first cavity extending within the second rod portion from the first end of the second rod portion, wherein the first cavity has an inner diameter that is larger than the outer diameter defined by the first rod portion, such that the second rod portion is configured to receive at least a part of the first end of the first rod portion within the second cavity via the first end of the second rod portion; and on at least one of the second end of the first rod portion or the second end of the second rod portion, a tension adjustment assembly comprising:

a support member affixed to said at least one of the second end of the first rod portion or the second end of the second rod portion, said support member externally threaded along at least a portion of its length;

a hollow cylinder, wherein said cylinder is threaded internally, wherein the threads of said cylinder and the threads of said support member are mated, allowing the cylinder to rotate about and travel along the threaded portion of the support member; and wherein said cylinder further comprises a ridge about an outer diameter of the cylinder;

an end cap, said end cap disposed on the cylinder by said ridge and able to rotate freely about said cylinder independently of any rotation of the cylinder about the support member; and a foot attached to said end cap.

2. The load-supporting rod assembly of claim 1, said cylinder further comprising a surface treatment.

3. The load-supporting rod assembly of claim 2, wherein said surface treatment increases friction of an external surface of said cylinder relative to friction of the external surface of the cylinder without the surface treatment.

4. The load-supporting rod assembly of claim 1, further comprising a separating means selected from the group consisting of a spring and an elastic cushion.

5. The load-supporting rod assembly of claim 1, wherein the support member is affixed by crimping of an end of an adjacent rod portion.

6. The load-supporting rod assembly of claim 1, wherein the support member is an integral threaded rod end.

7. The load-supporting rod assembly of claim 1, wherein the ridge includes a plurality of interruptions.

8. A tension adjustment assembly for a curtain rod, comprising:

a support member capable of being affixed to said at least one of a tension rod, said support member externally threaded along at least a portion of its length;

a cylinder, wherein said cylinder is threaded internally, wherein the threads of said cylinder and the threads of said support member are mated, allowing the cylinder to rotate about and travel along the threaded portion of the support member; and wherein said cylinder further comprises a ridge about an outer diameter of the cylinder;

an end cap, said end cap disposed on the cylinder by said ridge and able to rotate freely about said cylinder independently of any rotation of the cylinder about the support member; and a foot attached to said end cap.

9. A curtain rod comprising the tension adjustment assembly of claim 8.

10. The tension adjustment assembly of claim 8, said cylinder further comprising a surface treatment.

11. The tension adjustment assembly of claim 10, wherein said surface treatment increases friction of an external surface of said cylinder relative to friction of the external surface of the cylinder without the surface treatment.

12. The load-supporting rod assembly of claim 8, wherein the support member is a threaded rod end.

* * * * *